United States Patent [19]

Dale et al.

[11] Patent Number: 5,064,380

[45] Date of Patent: Nov. 12, 1991

[54] ELECTRICAL TAP AND SPLICE CONNECTOR

[75] Inventors: James L. Dale, Lawrenceville; Vernon R. Miller, Atlanta; Lincoln E. Roberts, Decatur, all of Ga.

[73] Assignee: AMP Incorporated, Harrisburg, Pa.

[21] Appl. No.: 532,463

[22] Filed: Jun. 1, 1990

Related U.S. Application Data

[63] Continuation-in-part of Ser. No. 400,315, Aug. 28, 1989, Pat. No. 4,997,338.

[51] Int. Cl.[5] ..... H01R 25/00

[52] U.S. Cl. ..... 439/113; 439/405; 439/492

[58] Field of Search ..... 439/492–499, 439/110–115, 395, 404, 405, 422, 512, 513

[56] References Cited

U.S. PATENT DOCUMENTS

| | | | |
|---|---|---|---|
| 3,018,463 | 1/1962 | Cataldo | 439/573 |
| 3,444,506 | 5/1969 | Wedekind | 399/99 |
| 4,146,287 | 3/1979 | Jonsson | 439/651 |
| 4,462,656 | 7/1984 | Beyer | 439/654 |
| 4,959,019 | 9/1990 | Shimiochi | 439/121 |

FOREIGN PATENT DOCUMENTS

| | | | |
|---|---|---|---|
| 0663492 | 5/1965 | Belgium | 439/110 |
| 212015 | 3/1987 | European Pat. Off. | 439/52 |
| 2179804 | 3/1987 | United Kingdom | 439/498 |

*Primary Examiner*—David L. Pirlot

*Attorney, Agent, or Firm*—Robert W. Pitts; William B. Noll

[57] ABSTRACT

Cable tap and splice assembly for selectively connecting tap conductors to cable wire conductors comprises a housing having a cable wire locator for locating the cable wires in predetermined coplanar positions. A plurality of bus conductors are provided in the housing and extend parallel to the cable wires with each bus connector being dedicated to, and associated with, a single cable wire. The bus conductors have receptacle sites which are accessible from the exterior of the housing so that terminals can be mated with the bus conductors. Connecting devices extend from the bus conductors to the cable wires. The assembly has a major surface having defined zones, each of which receives an electrical connector that has male terminals which are mated with specific cable wires when the connector is coupled to the major surface. The bus conductors can also connect two connecting devices engaging two wires in separate cables positioned in abuttment with a central, removable, partition in the cable clamp.

17 Claims, 19 Drawing Sheets

1
2
2
10
10
12
12
13
14
15
16
18
20
22
22
24
26
28
30
32
34

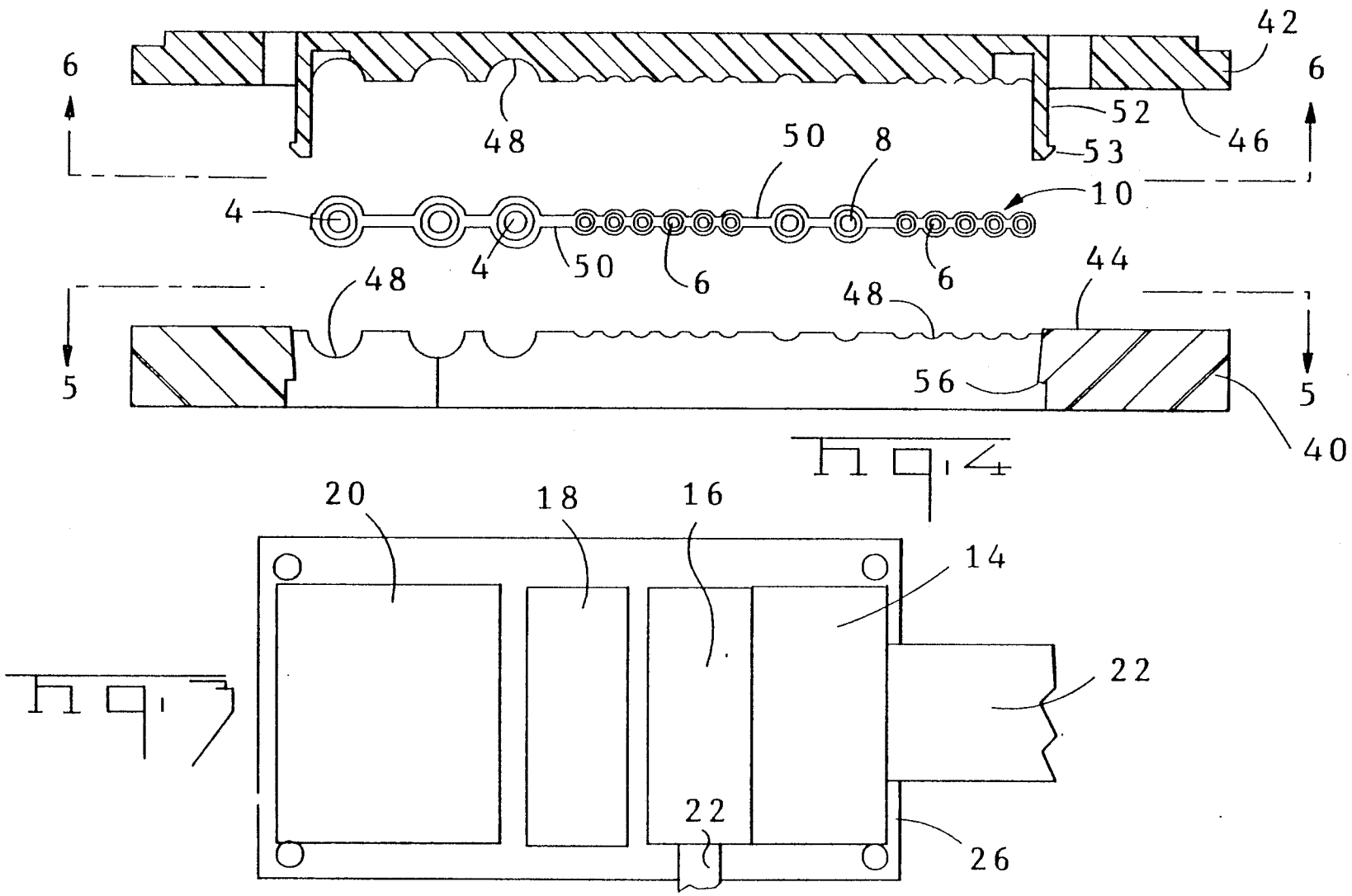
6
42
46
52
53
10
8
50
6
48
4
4
48
6
5
40
44
56
48
50
6
5
4
14
16
18
20
22
22
26
1

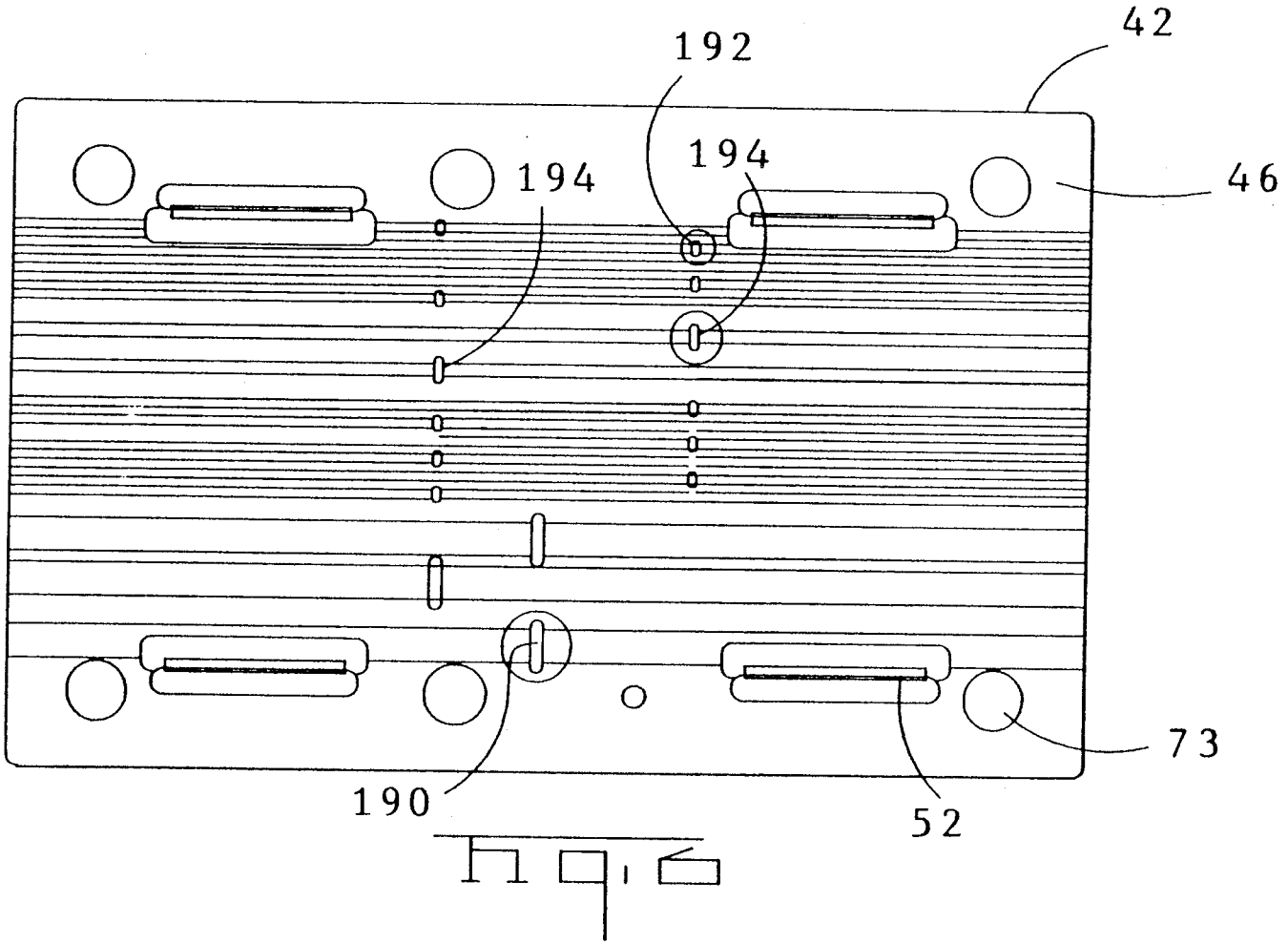
42
46
192
194
194
190
52
73

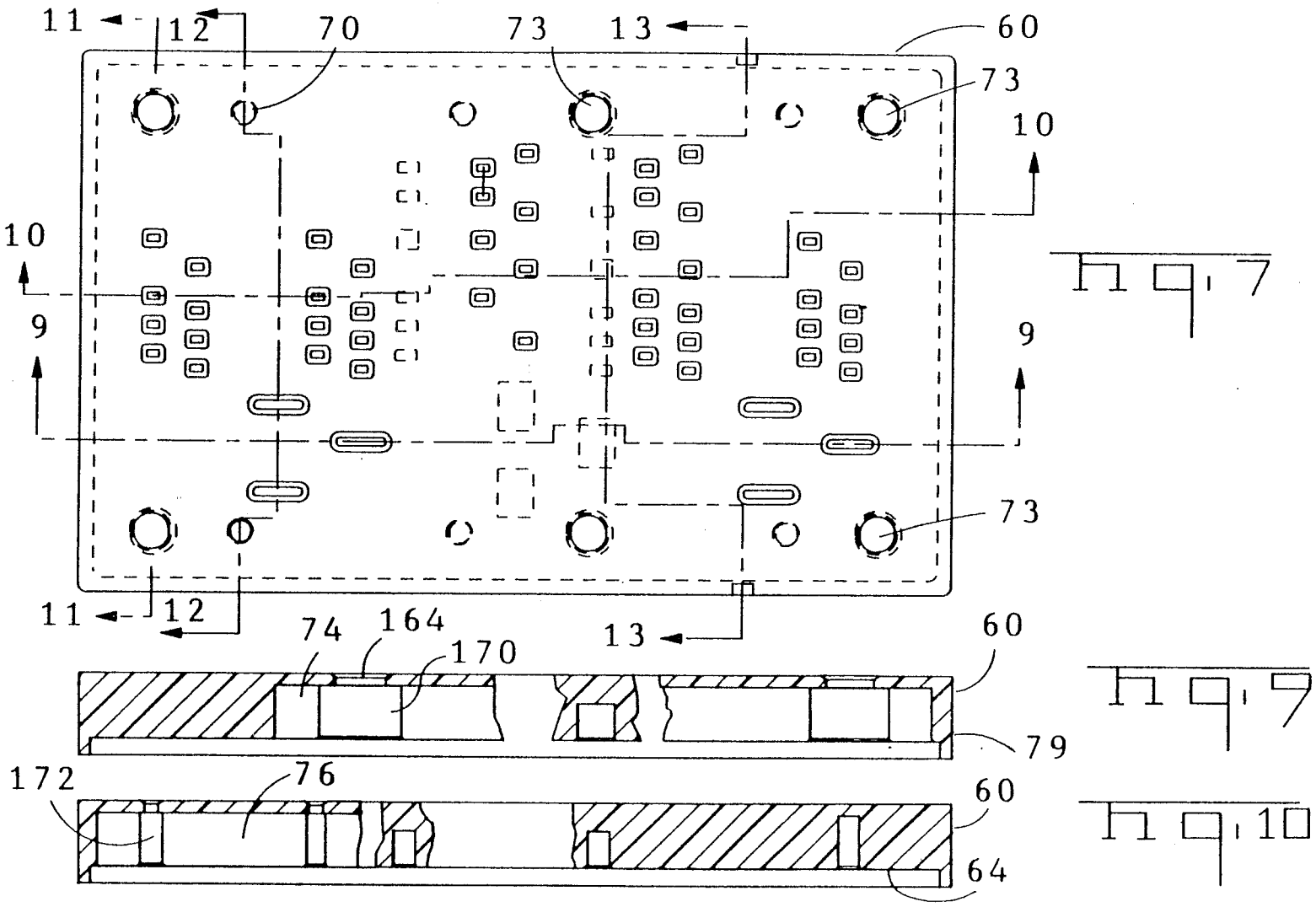
60
73
10
9
73
60
79
60
64
13
73
13
170
164
70
74
76
12
12
11
11
10
9
172

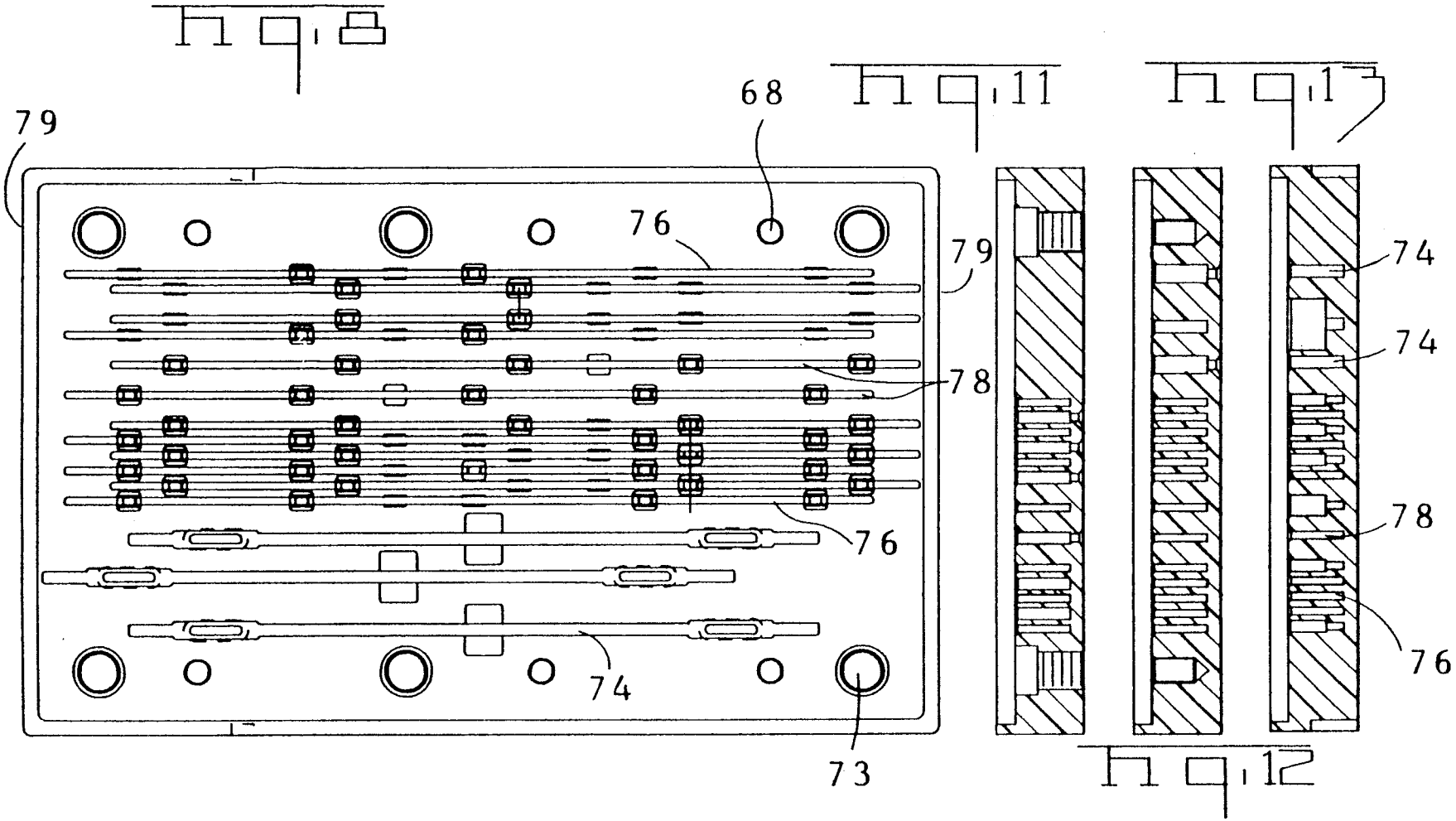
74
74
78
76
11
12
79
78
76
73
68
76
74
79

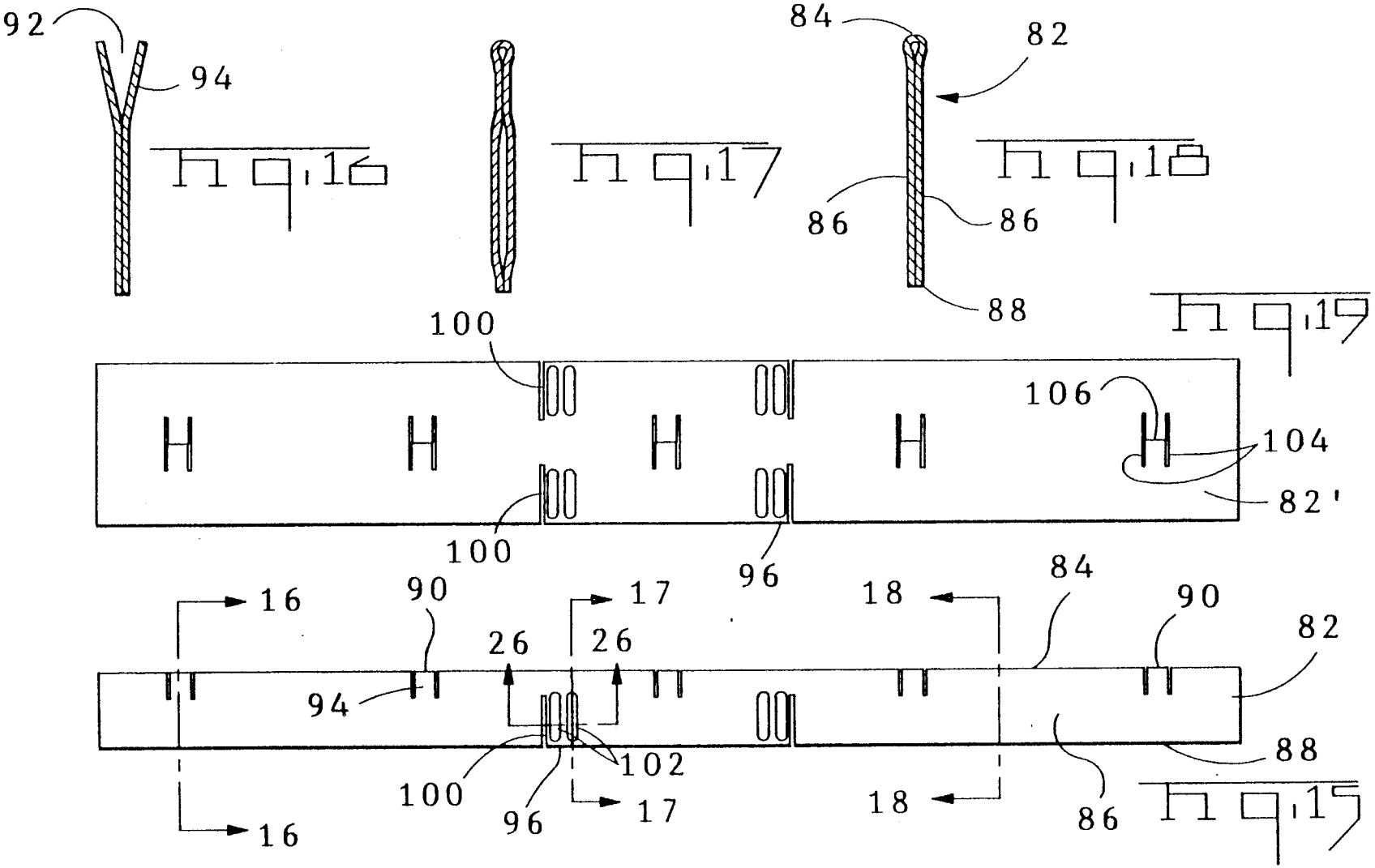
82
84
86
86
88
92
94
16
17
18
82'
104
106
96
100
100
90
102
26
26
17
16
18
82
84
86
88
90
94
96
100

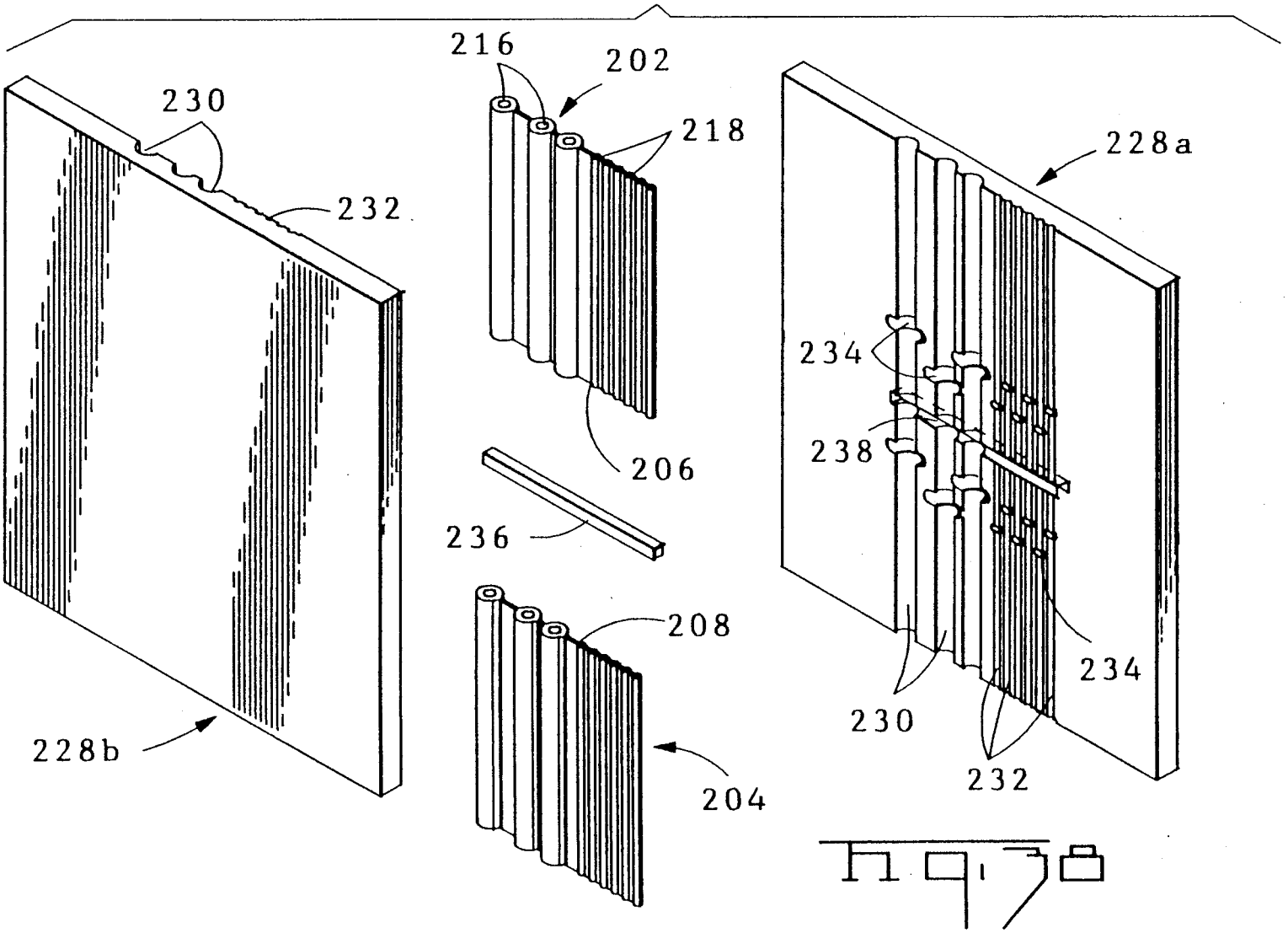
228a
234
232
230
234
238
218
202
216
206
236
208
204
232
230
228b

ELECTRICAL TAP AND SPLICE CONNECTOR

This application is a continuation in part of Application Ser. No. 07/400,15 filed Aug. 28, 1989, now U.S. Pat. No. 4,997,338.

FIELD OF THE INVENTION

This invention relates to electrical connectors for making tap or branch connections to conductors in an electrical cable.

BACKGROUND OF THE INVENTION

U.S. Pat. No. 3,444,506 is representative of known devices for making electrical tap connections to the conductors in a flat conductor cable. The connecting system shown in that patent comprises an insulating support having a plurality of double-ended connecting devices mounted therein. One end of each connecting device extends beyond a cable supporting surface of the insulating support and has a wire-receiving slot therein for reception of a wire in the cable. The other end of each connecting device extends beyond the opposite surface of the insulating support so that a further connecting device can be coupled to the other end of each connecting device. In use, the cable is clamped against the one surface so that the individual wires in the cable are moved into the wire-receiving slots of the connecting devices and the further connecting device can then be coupled to the other ends of the connecting devices.

The connecting device shown in U.S. Pat. No. 3,444,506 lacks several advantages which are achieved in the practice of the present invention as will be described below. For example, the connecting device shown in the prior art patent requires that a separate connecting device be used for every connection which must be made between a conductor in the cable and the external conductor to which the cable conductor is to be connected. If two or three external conductors are required to be connected to a single cable conductor, three connecting devices must be connected to the cable conductor. It follows that a specialized connecting device must be manufactured for every specific circuit arrangement requiring electrical connections between the conductors in the cable and the external conductors, the specialized device being produced with connecting devices at the precise locations which are needed for the circuit patterns which are to be achieved.

The connecting device shown in U.S. Pat. No. 3,444,506 requires that all of the wires in the flat conductor cable be of the same gauge and there are many circumstances under which it would be desirable to make connections to a cable having wires of different gauges therein.

The present invention is directed to the achievement of a connector for making tap connections to the conductors in a flat conductor cable which has a high degree of versatility as regards, for example, the number of wires in the cable, the gauges or diameters of the wires, and the number and locations of the electrical connections between the cable wires and the external conductors. The invention is further directed to the achievement of a tap connector system which permits conventional electrical connectors having male tab contacts extending from their mating faces to be coupled to the tap connecting device and thereby connected to the conductors in the flat cable. The invention is also directed to the achievement of a tap connector by means of which two or more electrical connections can be made to an individual conductor in the cable and which can be mated with electrical connectors that have male tab contacts extending therefrom.

THE INVENTION

The invention comprises, in one embodiment, a cable tap and splice connector for selectively connecting each one of a plurality of tap conductors to a predetermined cable wire in a cable in accordance with a specific wiring plan. The tap conductors include male terminals on their ends, the terminals being contained in a plurality of connector housings. Each male terminal is in a predetermined position in a predetermined one of the connector housings. The cable tap connector assembly comprises a housing assembly having a plurality of elongated bus conductors and a cable wire locating means therein for locating the cable wires in side-by-side parallel relationship with the bus conductors extending parallel to the cable wires and with each bus conductor being associated with a single cable wire when the cable wires are placed in the wire locating means. Each of the bus conductors has a cable wire connecting device thereon for forming an electrical connection with its associated cable wire. The housing assembly has a major surface and the bus conductors and the cable wires extend parallel to the major surface with the bus conductors proximate to the surface and the cable wires remote from the major surface. Each of the bus conductors has at least one receptacle site for reception of a male terminal. Each receptacle site is in a predetermined position between the ends of its respective bus conductor and the housing assembly has openings extending from the major surface to the receptacle sites. The major surface has a plurality of zones thereon, each zone containing a plurality of openings which extend to a group of receptacle sites on predetermined bus conductors. The openings in each zone are located in positions which correspond to the positions of a group of predetermined male terminals in a predetermined one of a connectors so that upon placement of the cable wires in the cable wire locating means, the tap conductors can be connected to the cable wires in accordance with the specific wiring plan by coupling the connectors with the receptacle sites in the zones on the major surface. In the preferred embodiment, each of the bus conductors and its associated cable wire are coplanar and define a plane which extends substantially normally of the major surface. The center to center spacing between adjacent bus conductors is the same as the center to center spacing between adjacent cable wires.

In one embodiment, the cable tap connector is characterized in that the assembly is intended for a cable which comprises some cable wires that have a relatively coarse gauge and other cable wires which have a relatively fine gauge. The larger buses and smaller buses match the current and voltage characteristics of the course and fine wires in the cable respectively. The coarse gauge wires are connected to relatively heavy or large male terminals and the finer gauge wires in the cable are connected to relatively smaller male terminals. The male tab terminals may in turn be connected to relatively coarse and fine gauge tap wires or may be connected to active devices in the connector housings.

In the preferred embodiment, the housing assembly comprises a bus housing subassembly and a cable wire locating and clamping subassembly. The subassemblies have opposed internal faces which are substantially against each other with the bus conductors in the bus conductor subassembly and the cable wire locating means in the cable wire locating subassembly. The bus conductors are contained in parallel slots which are proximate to the internal face of the bus conductor subassembly. The bus conductors in one embodiment are sheet metal bus bars having receptacle portions for the male contact members and having connecting devices thereon which extend to the cable conductors in the cable clamping and locating means. The connecting devices which extend from the bus conductors to the cable conductors are, in one embodiment, separate sheet metal double-ended connecting devices which are mated with the bus conductors and which have wire receiving slots for establishing electrical contact with the cable conductors. The connecting devices extend through internal passageways in the housing assembly which extend between the bus receiving slots and the cable locating means.

In other embodiments, the assembly comprises a cable tap and splice assembly or junction box. In addition to providing a tap, two cables can be butt spliced through the same bus bars used for the taps. In these embodiments two cable contact terminals are used for each wire. These cable contact terminals are interconnected by the bus bars in the main housing. A removable dam or partition is retained in the cable tap so that the ends of two cables can be properly aligned to insure proper splicing.

THE DRAWING FIGURES

FIG. 3 is a plan view showing the locations of connectors coupled to the cable tap assembly.

FIG. 4 is a sectional exploded view showing the two sections of the cable clamping and wire locating subassembly.

Figure 5:
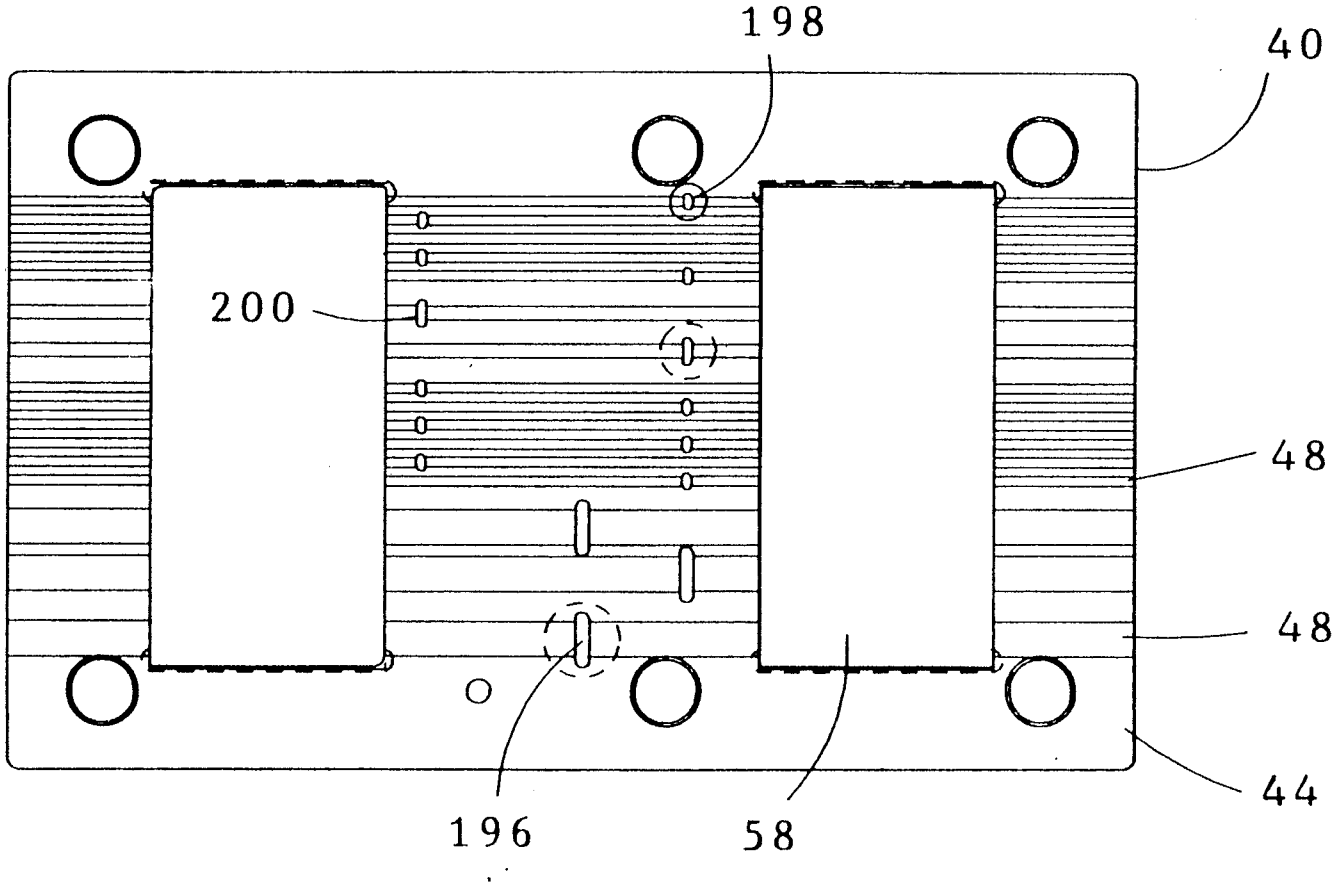

FIGS. 5 and 6 are views looking in the direction of the arrows 5—5 and 6—6 of FIG. 4.

FIG. 7 is a top plan view of the bus conductor housing body.

FIG. 8 is a plan view of the underside of the bus conductor housing body.

FIGS. 9, 11, 12, and 13 are sectional views looking in the directions of the correspondingly numbered arrows of FIG. 7.

Figure 14:
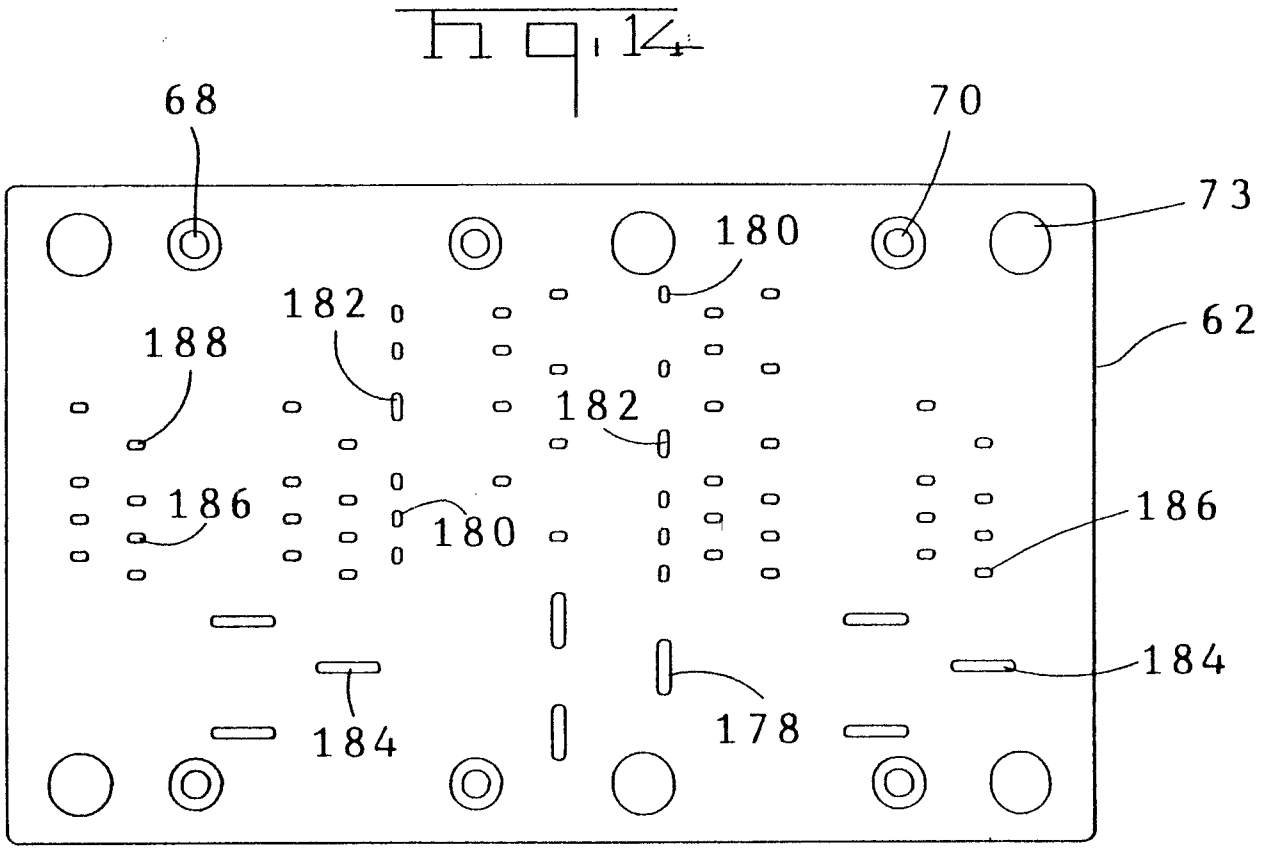

FIG. 14 is a plan view of the cover and retaining plate of the bus housing subassembly.

Figure 15:
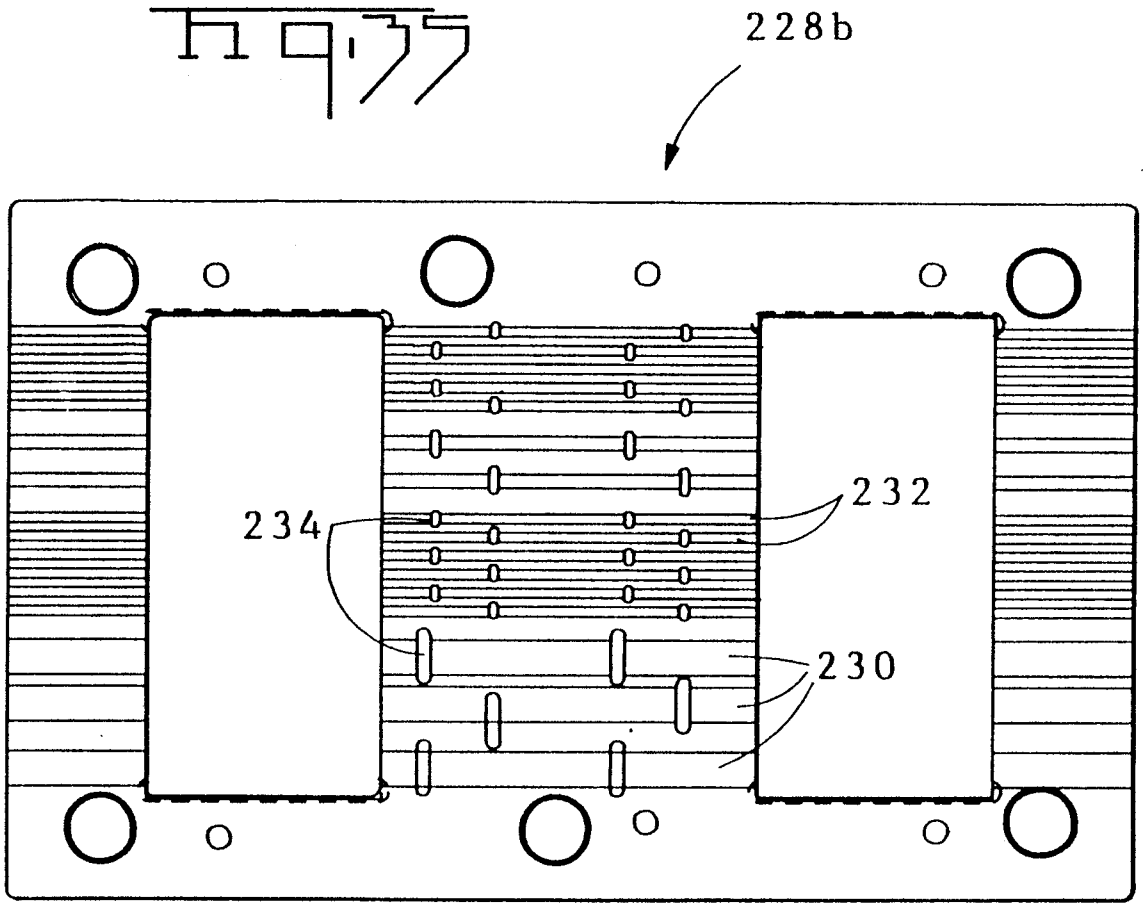

FIG. 15 is a side view of one of the bus bars which are contained in the bus housing.

Figure 17:
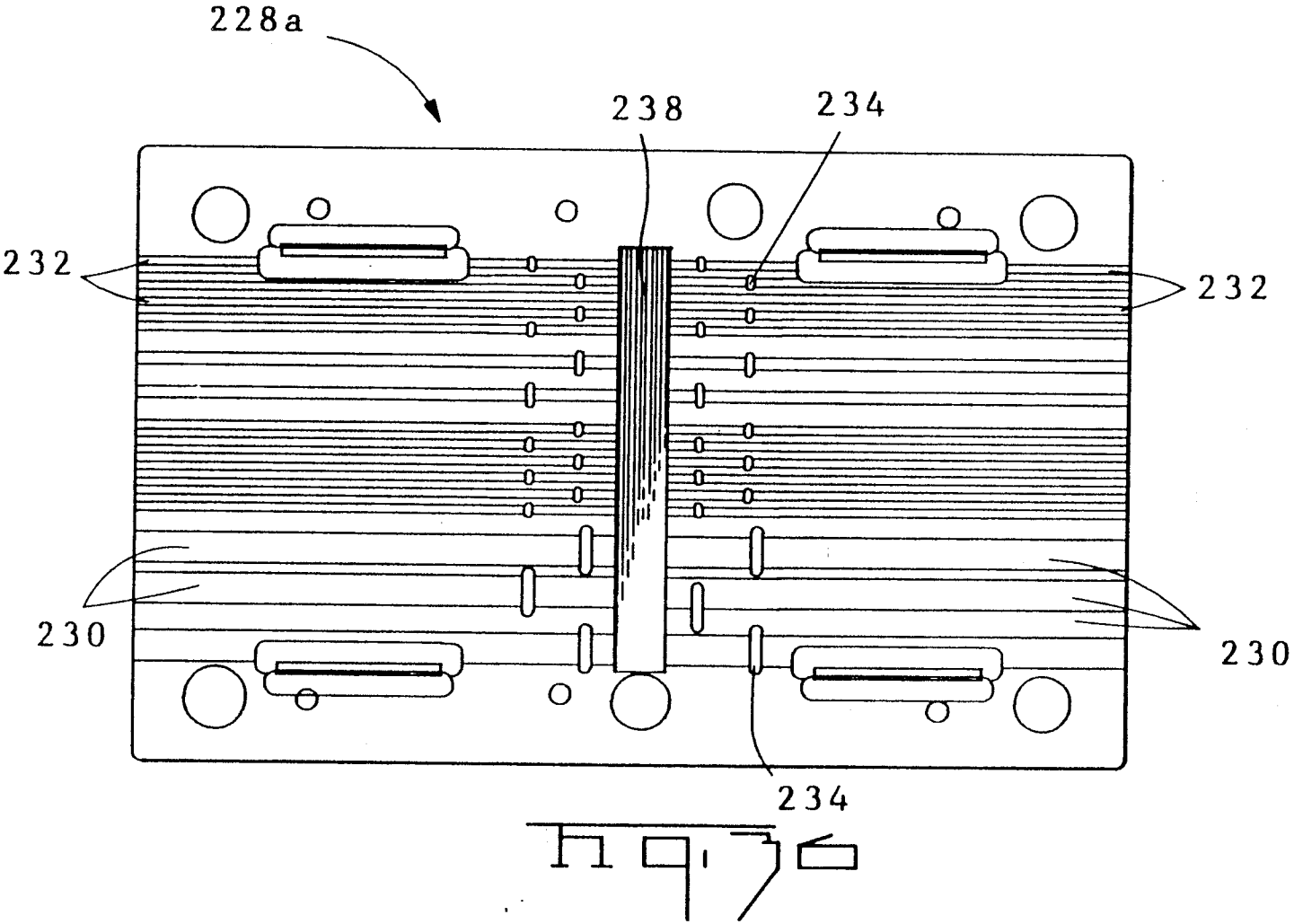
Figure 17:
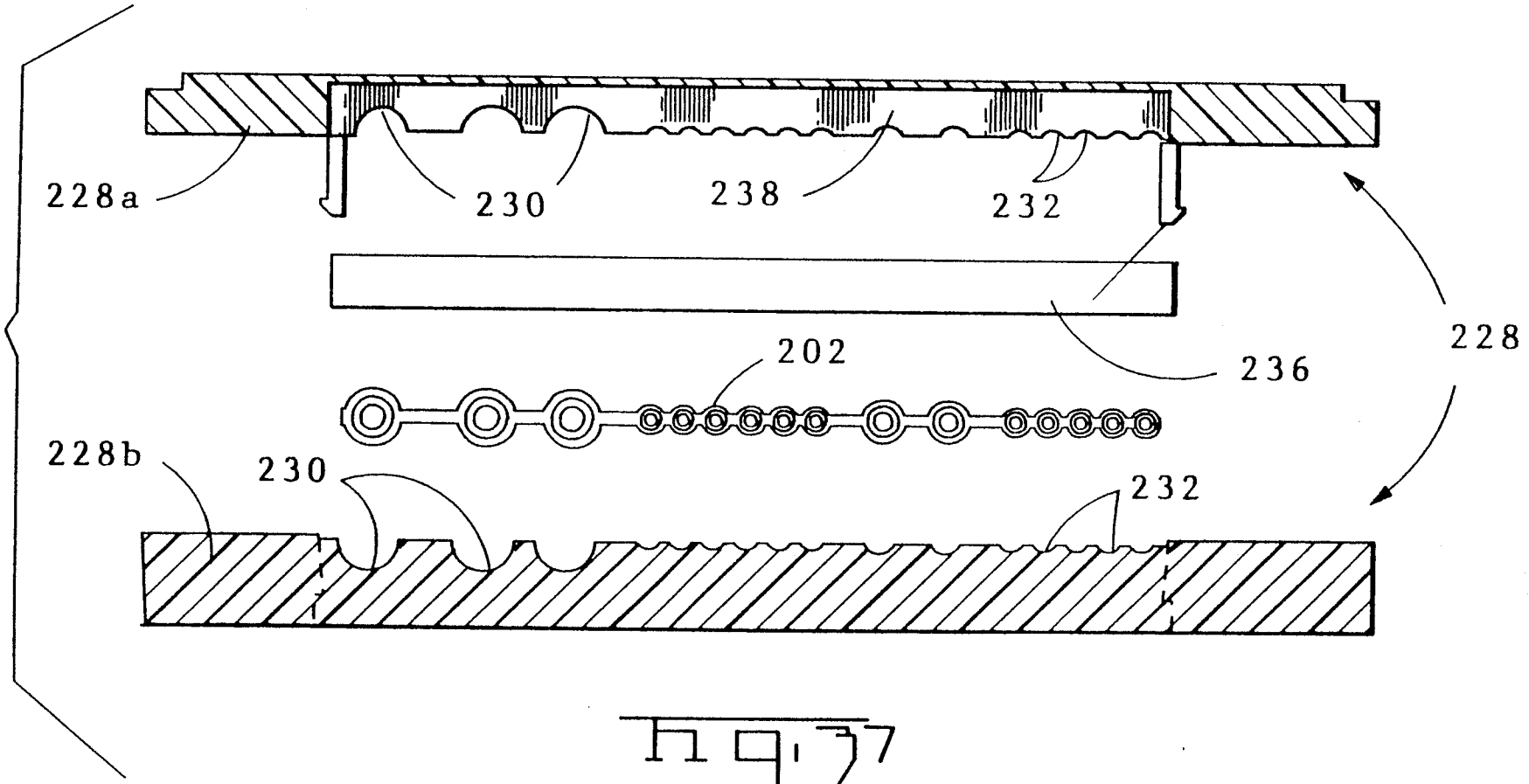

FIGS. 16, 17, and 18 are views looking in the directions of the correspondingly numbered arrows in FIG. 15.

FIG. 19 is a plan view of the blank from which the bus bar of FIG. 15 is formed.

Figures 20, 21, 22, 27:
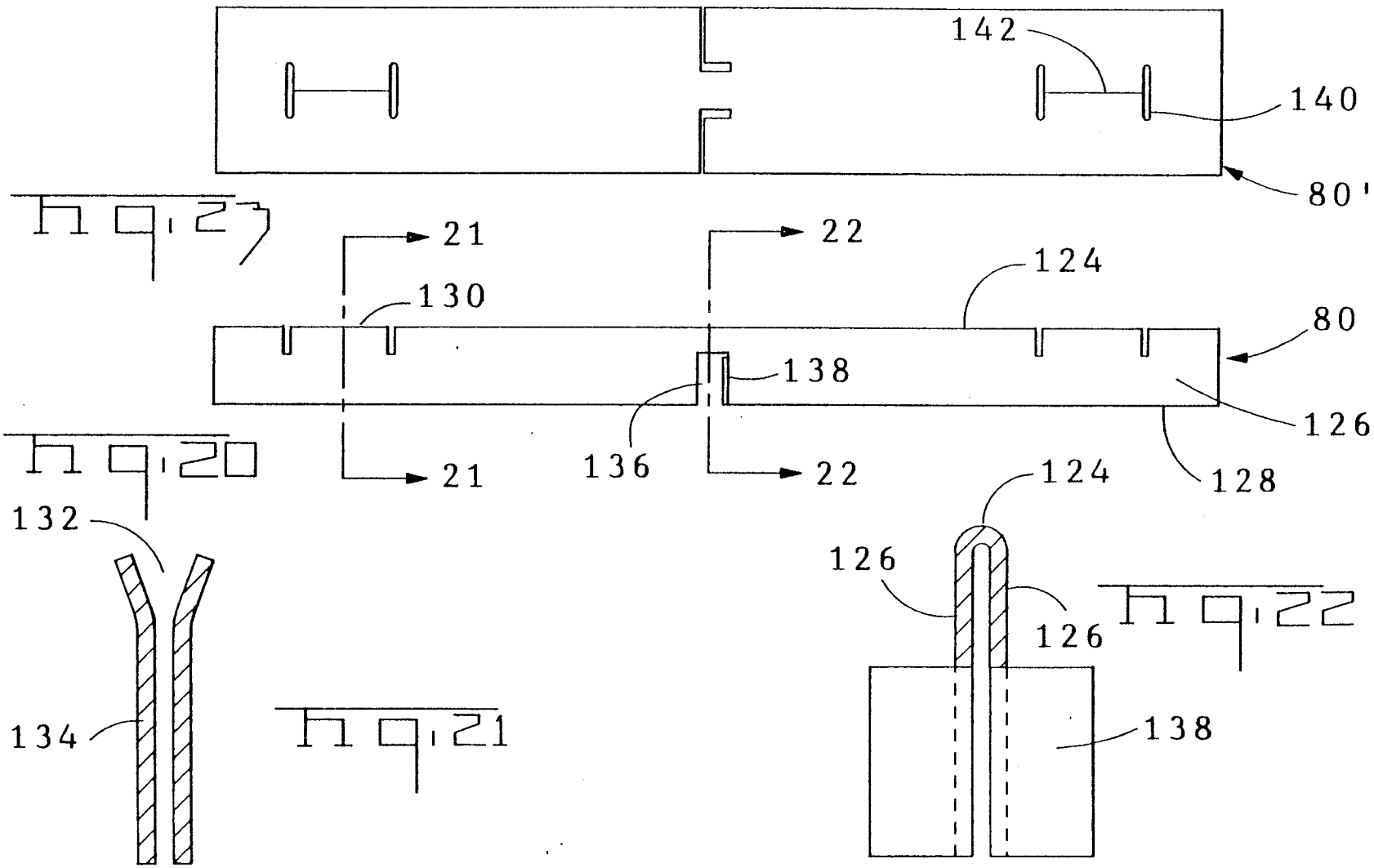

FIG. 20 is a side view of another type of bus bar which is contained in the bus housing.

FIGS. 21 and 22 are sectional views looking in the directions of the correspondingly numbered arrows in FIG. 20.

FIG. 23 is a plan view of the blank from which the bus bar of FIG. 20 is formed.

Figure 24:
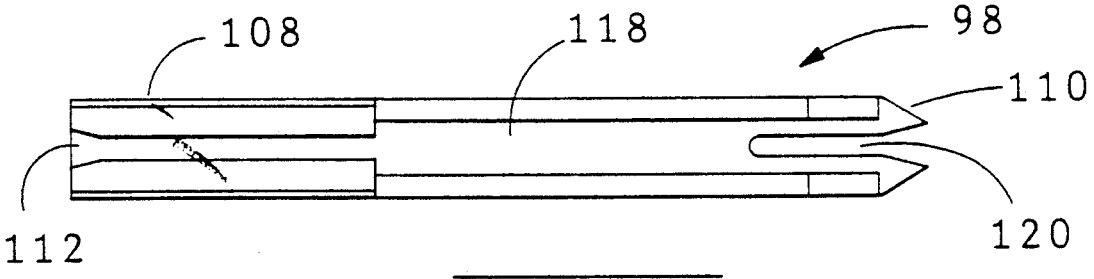

FIG. 24 is a frontal view of a connecting device used with the bus bar of FIG. 15.

Figure 25:
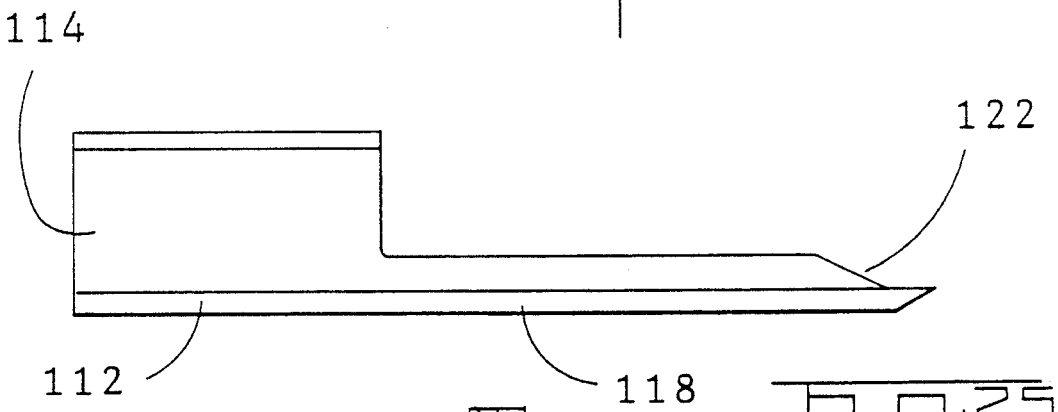

FIG. 25 is a sectional view looking in the direction of the arrows 25—25 of FIG. 24.

Figure 26:
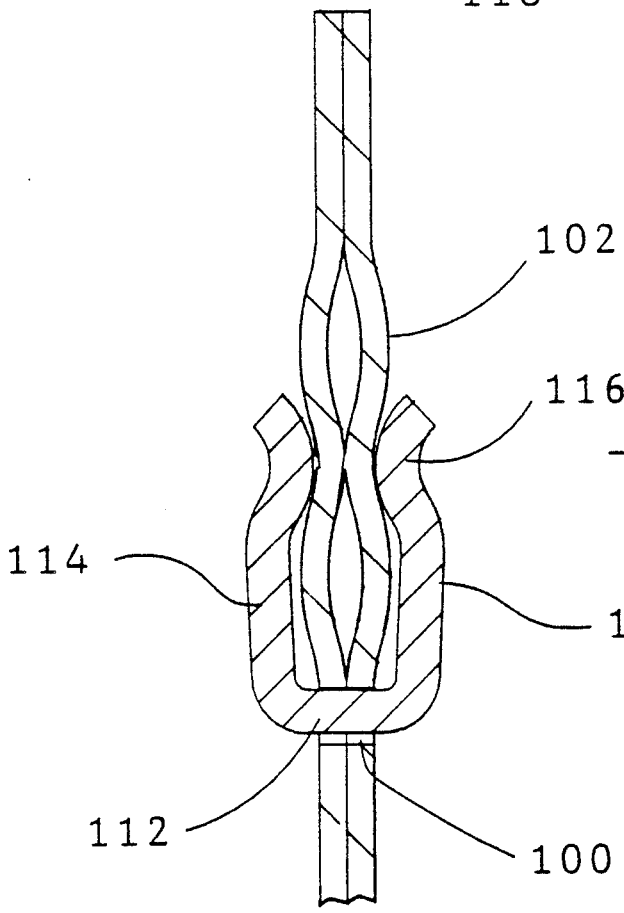
Figure 27:
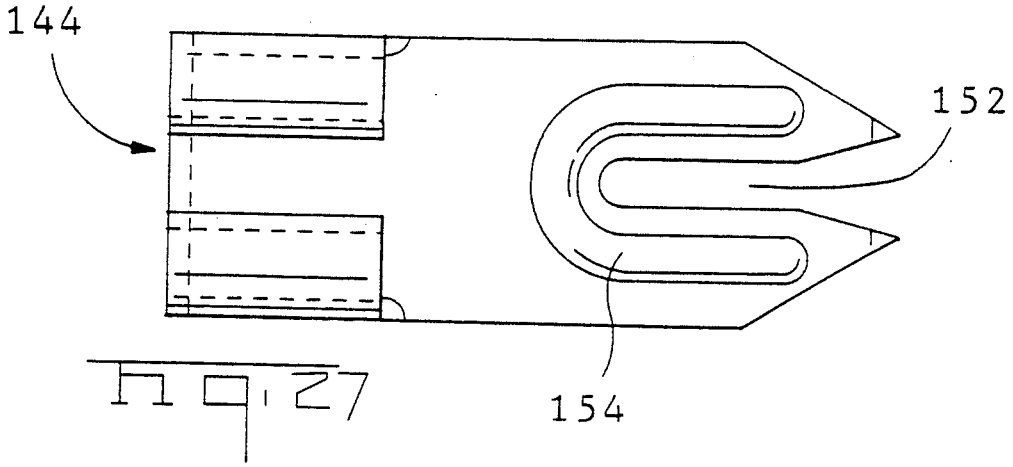

FIG. 26 is a view looking in the direction of the arrows 26—26 of FIG. 15 and showing the connecting device of FIG. 25 coupled to the bus bar.

FIG. 27 is a frontal view of the type of connecting device used with the bus bar shown in FIG. 20.

Figure 28:
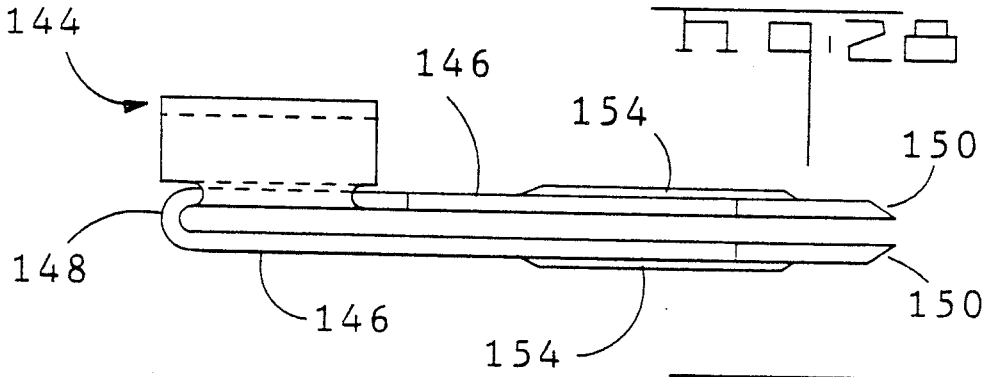
Figure 29:
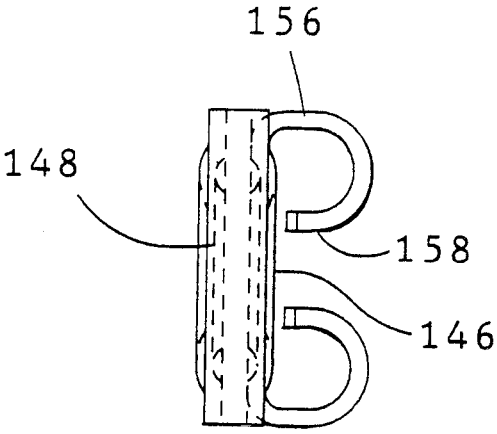

FIGS. 28 and 29 are side and top views of the connecting device shown in FIG. 27.

Figure 30:
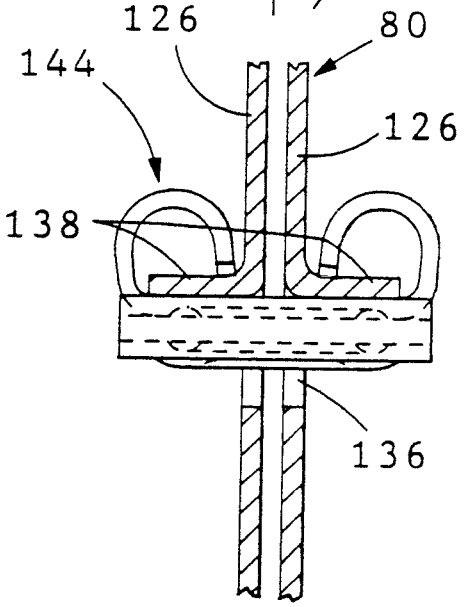
Figures 11, 12:
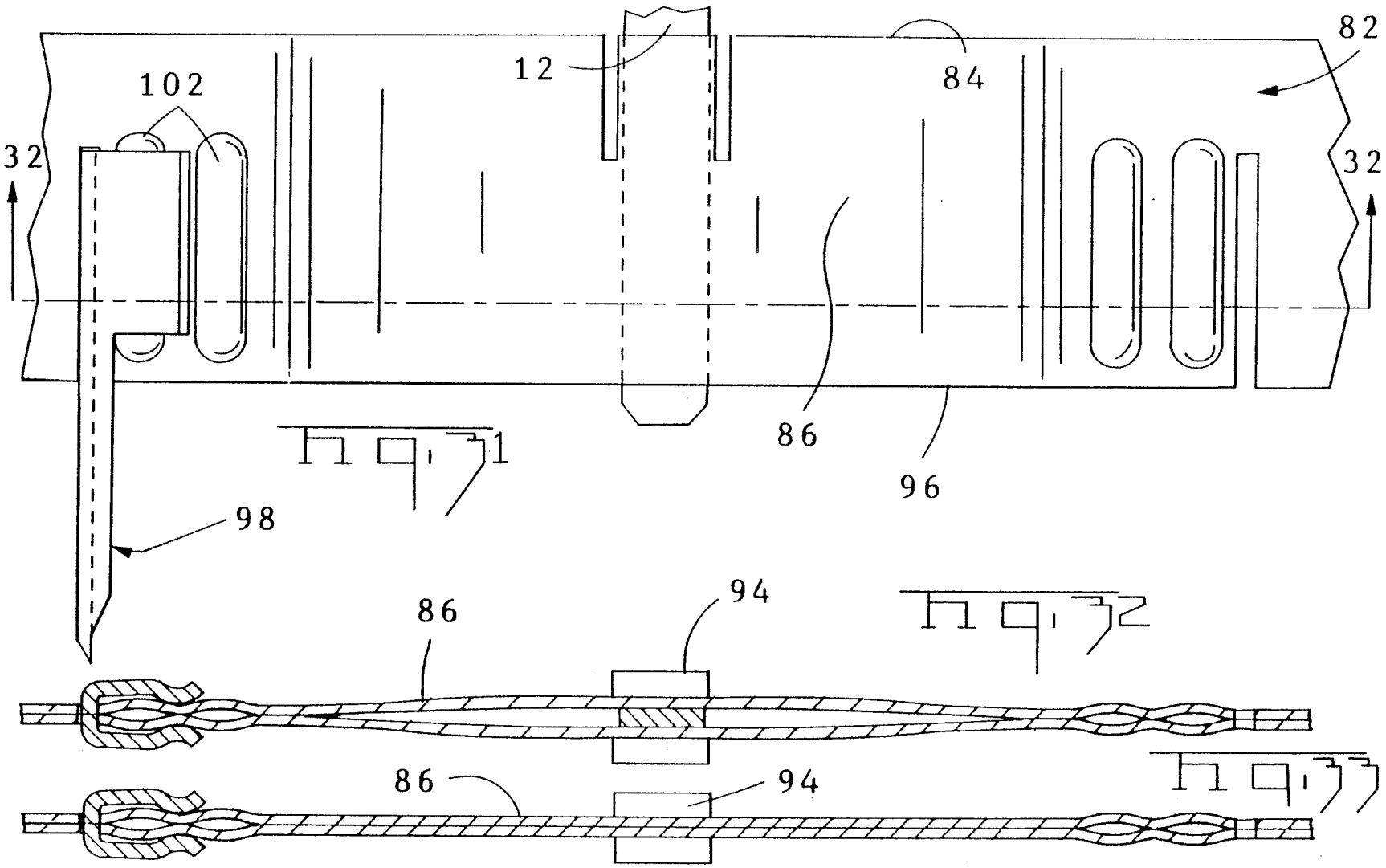
Figure 14:
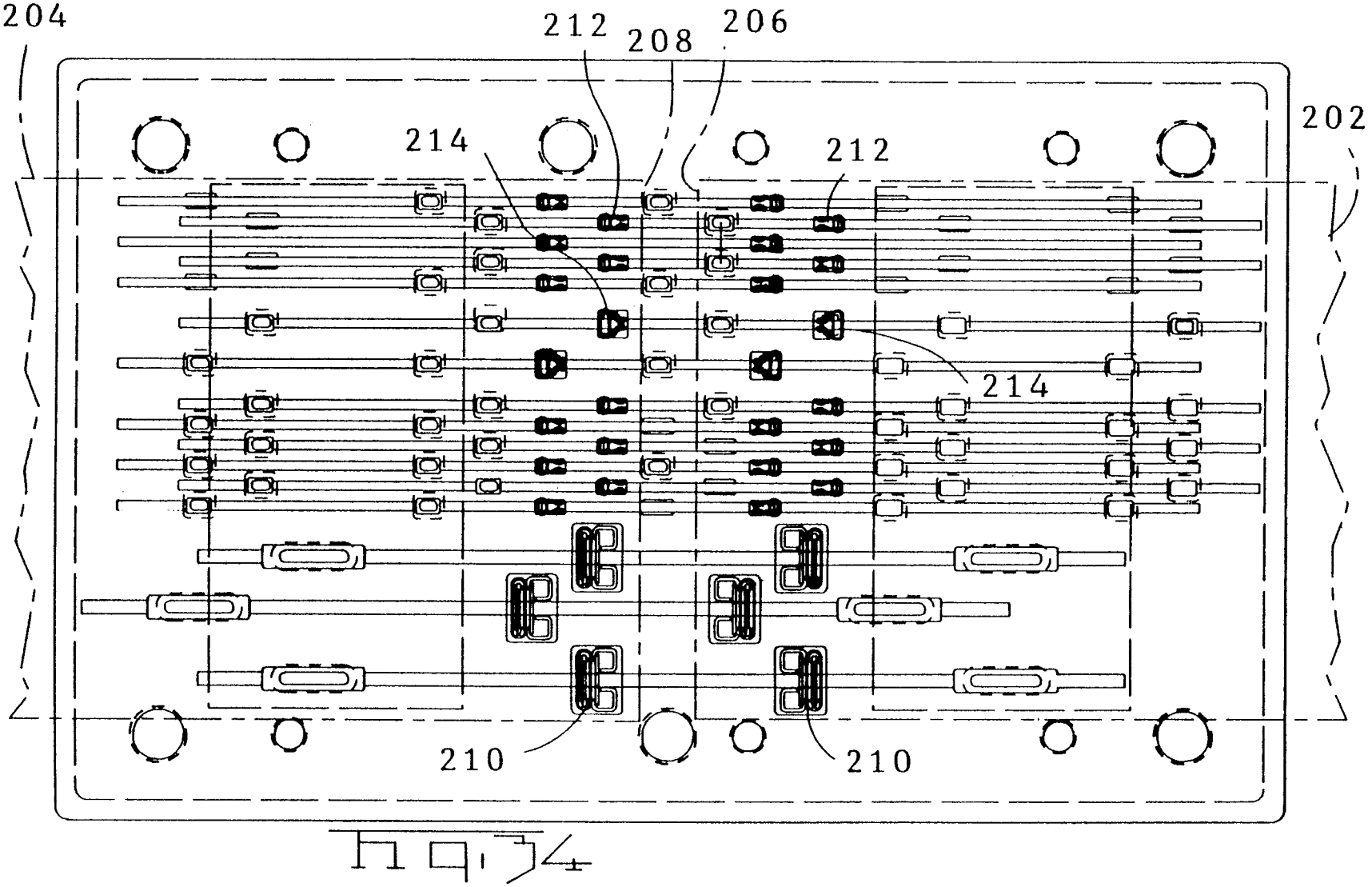

FIG. 30 is a sectional view showing the connecting device of FIG. 27 coupled to the bus bar of FIG. 20.

FIG. 31 is a fragmentary view of a portion of the bus bar of FIG. 15 showing a male tab terminal inserted into a receptacle site and showing a connecting device coupled to the bus bar.

FIG. 32 is a view looking in the direction of the arrows 32—32 of FIG. 31.

FIG. 33 is a view similar to FIG. 32 but showing the positions of the parts prior to insertion of the tab terminal.

FIG. 34 is a schematic view of an alternative embodiment which has the capability of splicing the ends of two cables.

FIG. 35 is a view of the rear clamp section employed with the embodiment of FIG. 34.

FIG. 36 is an embodiment of the front clamp part used in the embodiment of FIG. 34.

FIG. 37 is an exploded orthographic view of the elements of the cable tap and splice assembly of FIGS. 34–36.

FIG. 38 is an exploded perspective view of still another embodiment of the cable clamp suitable for use with a cable having fewer signal conductors.

Figure 39:
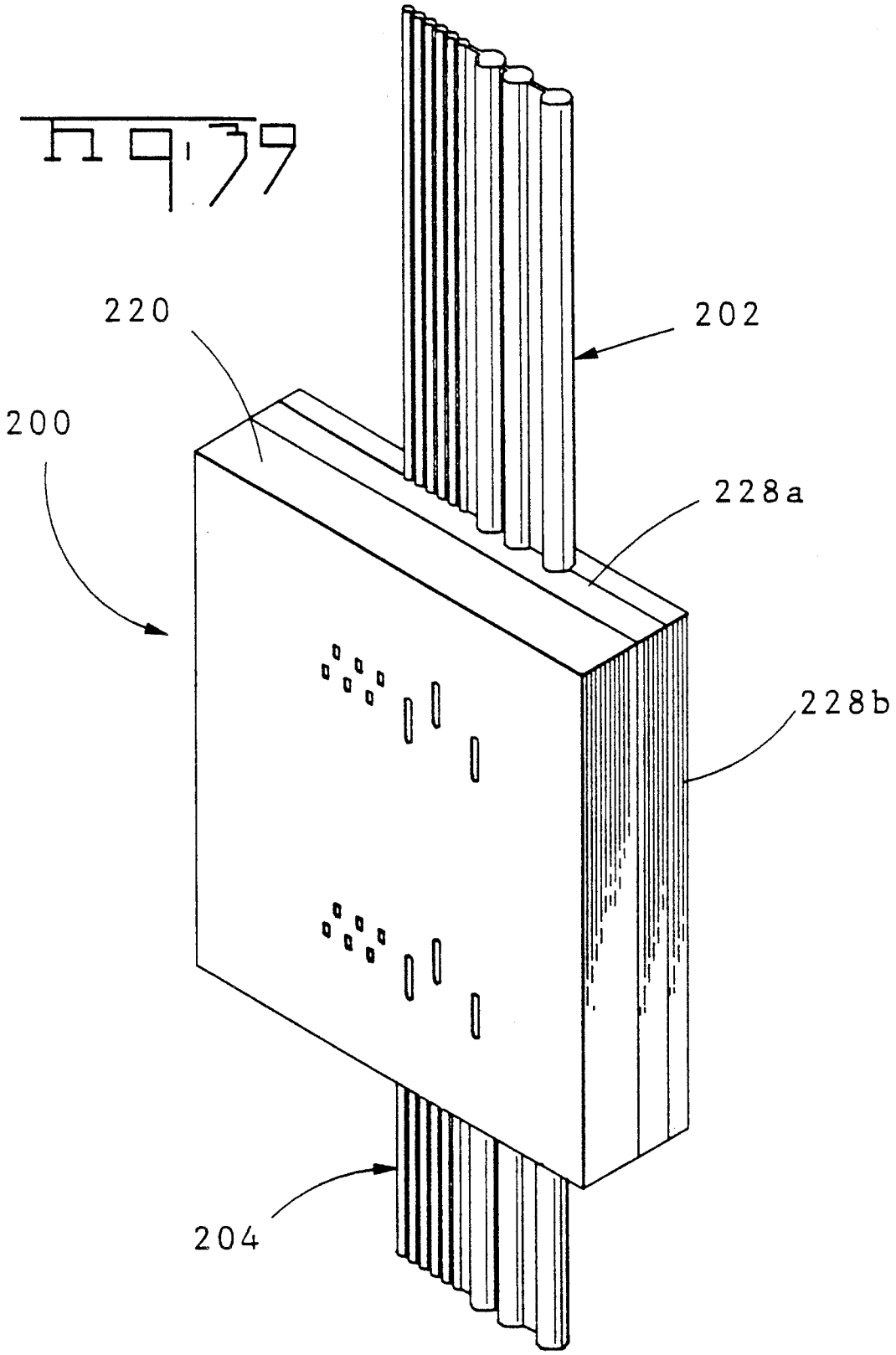

FIG. 39 is a perspective view of the cable splice assembly of FIG. 38.

THE DISCLOSED EMBODIMENT

Figure 1:
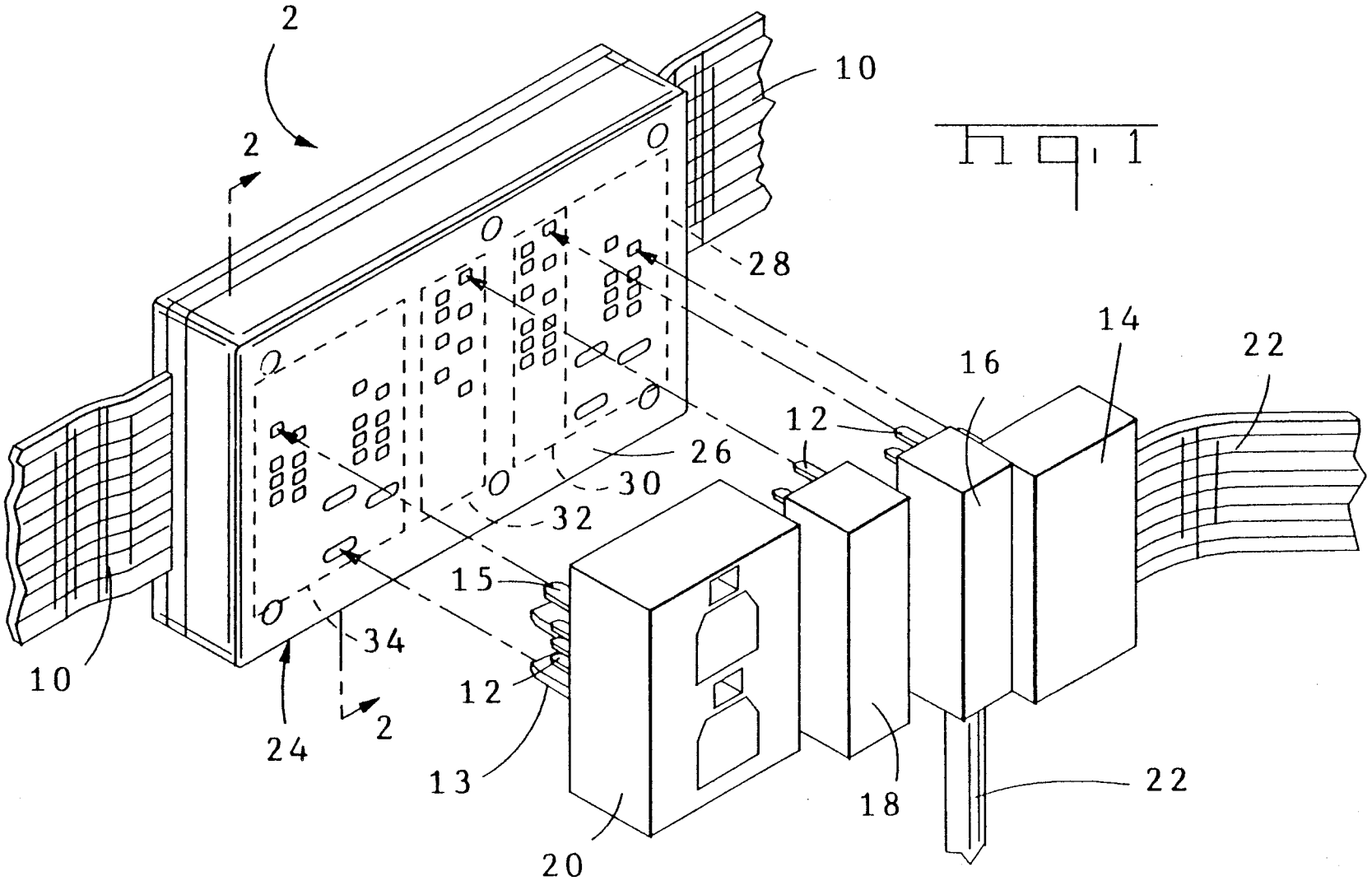
FIG. 1 is a perspective view of a cable tap assembly in accordance with the invention.
Figure 2:
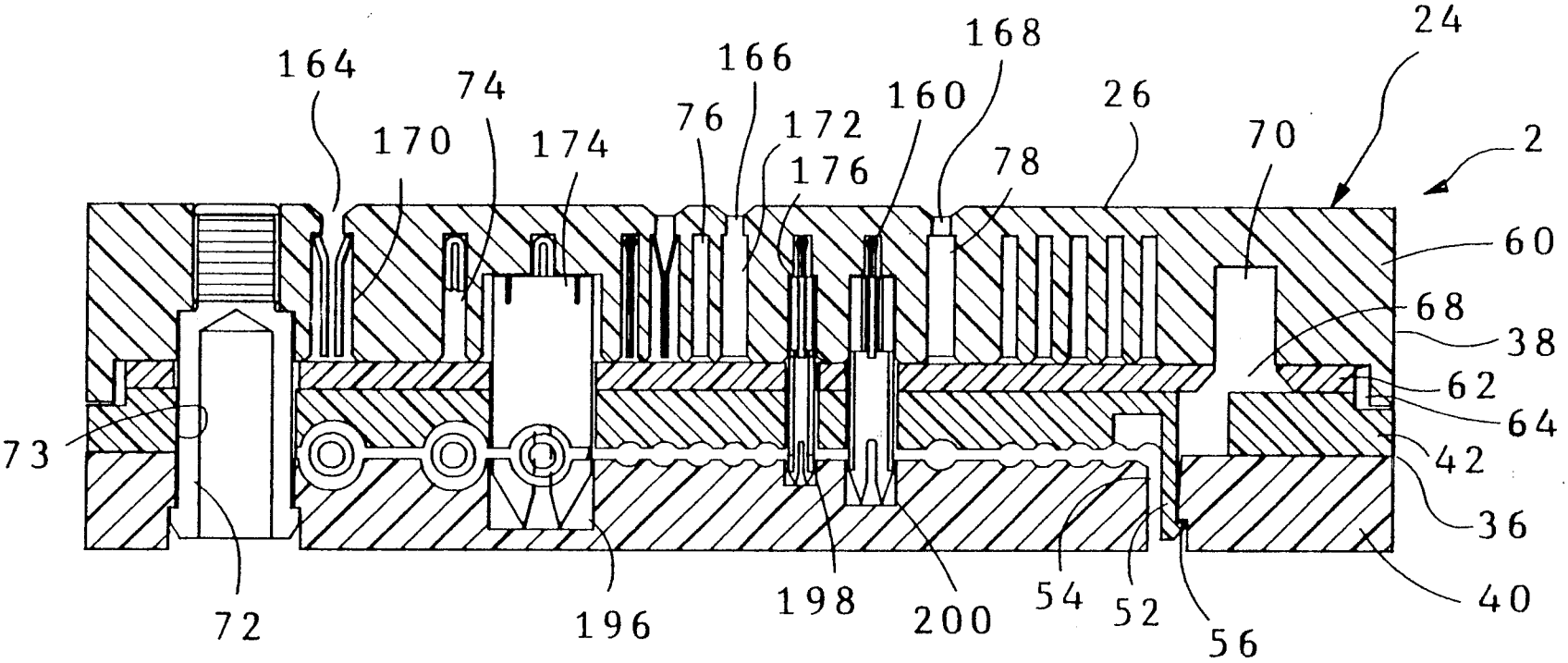
FIG. 2 is a sectional view taken along an irregular section line 2—2 in FIG. 1.

A cable tap connector assembly 2 in accordance with the invention, FIGS. 1–3, serves to connect male terminals 12, 13, 15 contained in connectors 14, 16, 18, 20 to wires 4, 6, 8 which are contained in a cable 10. The cable 10 (FIG. 4) has three relatively coarse wires 4, relatively fine gauge wires 6, and two wires 8 of intermediate gauge. A cable of this type might be used in the wiring for a building in which case the wires 4 would be power supply wires, the wires 6 could be control circuits and the intermediate gauge wires 8 might be part of an uninterrupted power system. The connectors 14, 16, 18, 20 can be conventional connectors having tap wires extending therefrom and having terminal tabs on the ends of the tap wires. Alternatively, they could contain active devices, for example, controlling devices for controlling appliances or apparatus to which the cable conductors extend. The term "connector" is used herein in a broad sense. One or more of the connectors might be a conventional connector having tap wires extending to tab terminals contained in the connector housing, one or more of the connectors may be a housing containing active devices but having no tap wires extending to the housing, and one or more of the connectors may be a hybrid containing an active device and having wires extending to terminals in the connector housing.

The connectors 14, 16, 18, and 20 have terminal tabs 12, 13, and 15 of varying sizes extending therefrom. The tabs 13 which are connected to the coarse gauge conductors are relatively large, the tabs 12 which are connected to the fine gauge conductors wires are relatively small, and the tabs 15 which are to be connected to the wires of intermediate gauge are of intermediate size.

The tap connector assembly 2 comprises a housing assembly 24 which has a major surface 26 which contains separate zones 28, 30, 32, and 34. Each zone receives one of the connectors 14–20 as shown in FIG. 3 and the male tab terminals extending from these connectors are connected to the individual cable wires 4, 6, 8 as will be described below.

The housing assembly 24 is made up of a cable clamping and wire locating subassembly 36 and a bus conductor housing subassembly 38. The cable clamping subassembly, FIG. 4–6, comprises two plate-like sections 40, 42 which have opposed surfaces 44, 46. These surfaces have semi-cylindrical depressions 48 located on the same centers as the conductors in the cable 10 and have diameters which match the diameters of the insulation on the wires in the cable. When the two sections are against each other, the conductors in the cable are firmly clamped in predetermined positions with the web portions 50 of the cable extending between adjacent conductors. The two sections 40, 42 are secured to each other by latch arms 52 which depend from the section 42 and which have latch ears 53 on their ends. The latch arms extend through openings in the lower section 40 and the ears lodge against latch shoulders 56 as shown in FIG. 2. Rectangular openings 58 are provided in the lower section 40 in order to permit inspection of the lower surface of the cable when the assembly has been installed on a cable. It can be determined by inspecting the cable through these openings if the cable is properly positioned in the depressions in the cable clamping sections.

The bus housing subassembly, FIGS. 2 and 7–14, comprises a main housing body 60 and a cover or retaining plate 62 which is fitted into a recess 64 on the underside of the housing body 60. This retaining plate or cover is secured to the main housing body by fasteners which extend through aligned openings 68, 70. The bus housing subassembly and the cable clamping subassembly are secured to each other by a plurality of plastic snap fasteners 72 which extend through aligned openings 73 in the two subassemblies.

The bus bars, which are described below, are contained in parallel slots 74, 76, 78 which extend inwardly from the downwardly facing surface of recess 64, as viewed in FIG. 2, of the housing body 60 and which extend parallel to the major surface. These slots extend between the ends 79 of the housing body 60 but are staggered as shown in FIG. 8 for reasons which will become apparent from the following description. The slots 74 receive bus bars 80 and the slots 76 receive bus bars 82.

When the cable tap connector 2 is placed in service, the coarse gauge wires 4 will carry a relativelv high current and the finer gauge wires 6, 8 will carry correspondingly lower currents. The bus bars 80, 82, 160 and the male tab terminals 12, 13, 15 are accordingly dimensioned so that they are suitable for the currents and voltages encountered.

Each of the bus bars 82, FIG. 15, is associated with one of the relatively fine gauge cable wires 6 and comprises a stamped and formed sheet metal member having a bight 84 and coextensive side walls or arms 86 which are against each other or substantially so as shown in Figure 18. A plurality of receptacle sites 90 are provided in the bight for tab terminals, each site comprising an opening 92 in the bight and divergent ears 94 which function as a guide or lead-in for the tab when it is inserted into the space between the side walls 86.

At least one cable wire connecting site 96 is provided for a connecting device 98 on the outer ends 88 of the side walls 86. Each connecting site 96 comprises aligned slots 100 which extend inwardly from the outer ends 88 and a pair of spaced-apart embossments 102 which extend parallel to the slots 100. The manner in which the connecting devices are coupled to the bus bar 82 is described below and shown in FIG. 26.

The bus bar 82 is produced from a flat blank 82', FIG. 19, by stamping parallel slots 104 in the blank between the side edges thereof and sharing the blank along share lines 106 which extend between the slots. The blank is then bent into the form shown in FIG. 18 so that the material on each side of the shear lines 106 form the divergent ears 94. The forming process should be carried out in a manner which will produce severe work hardening in the bight 84 in order that the side walls 86 may function as stiff springs as will be briefly described below.

The connecting device 98 (FIGS. 24–26) is of stamped and formed sheet metal and has an end, 108, which is coupled to the bus bar and an end 110 which is connected to the wire. The end 108 has a web section 112 from which side walls 114 extend. These side walls are inwardly formed at their outer ends as shown at 116. The device is coupled to the bus bar by moving the web into the aligned slots 100 so that the inwardly formed portions 116 of the side walls lodge in the depressions between the spaced-apart embossments 102.

The side walls are of reduced height in the intermediate portion 118 of the connecting device and are tapered adjacent to the end 110 as shown at 122. A wire receiving slot 120 extends inwardly from the end 110 and the web is pointed on each side of this slot to facilitate penetration of the insulation of the cable when the bus housing subassembly 38 is assembled to the cable clamping subassembly 36.

The bus bar 80, FIGS. 20–23 is of a heavier gauge sheet metal than the bus bar 82 for the reason that it is intended for use with the coarse gauge conductors in the cable and will therefore carry a higher current. This bus bar has a bight 124 from which the side walls or arms 126 extend tangentially. The receptacle sites 130 are formed as described above, that is by punching spaced-apart slots 140 in the flat blank 80' and sharing the material between the slots as shown at 142. When the blank is bent into the shape of FIGS. 21 and 22, the ears 134 will be flexed outwardly and the opening 132 for the male tab will be produced.

The cable wire connecting sites comprise relatively wide aligned slots or openings 136 which extend inwardly from the ends 128 of the side walls 126. Flanges 138 extend outwardly from the sides of the slots for cooperation with the terminals or connecting devices (FIGS. 27–29) which are coupled to the bus bar.

The connecting device 144 (FIGS. 27–30) comprise parallel plate-like members 146 which are joined to each other by a reversely bent portion 148 at their upper ends as viewed in FIG. 28. The ends of the plate-like members are pointed as shown at 150 and each plate-like member has a wire-receiving slot 152. Advantageously, the plate members are embossed as shown at 154 adjacent to the wire-receiving slots for added stiffness. The upper portions of each connecting device are connected to the bus bar by means of ears which extend from the plate-like member on the left shown in FIG. 28. Each ear 156 is reversely curled as shown at 158 so that its end is spaced from the surface of the associated plate member 146. The connecting device 144 can be coupled to its associated bus bar by moving the reversely bent section 148 into the aligned slots in an orientation such that the flanges are received between the ends of the ears 158 and the adjacent surface of the plate member 146 in the manner of a conventional quick disconnect electrical terminal.

A bus bar of intermediate size 160, FIG. 2, is provided for the conductors 8 in the cable 10 which are of an intermediate gauge and an appropriately sized connecting device is provided for the bus bar 160. The bus bar 160 can be of either type described above and need not therefore be described in detail.

FIGS. 31–33 illustrate the manner in which the bus bar 82 is deflected when a male tab terminal 12 is inserted into one of the receptacle sites. The side walls or arms 86 are flexed outwardly and bowed as shown in FIG. 32 by virtue of the fact that they are constrained by the bight portions 84 on each side of the receptacle sites. Extremely good area contact is achieved as shown in FIG. 32 and a high contact force can be achieved if desired. The force is produced in a large part by the bowing of the side walls but there is to some extent a contribution to the total force by the cantilever flexure of the side walls away from each other. The contributing factors to the total contact force are complex and will depend upon several variables such as the thickness of the material, the hardness, and the degree of work hardening in the bight 84. Advantageously, the parts are designed such that the flexure illustrated in 32 is entirely, or at least substantially, within the elastic range so that when the tab terminal 12 is removed, the parts return to their original positions as shown in FIG. 33.

The receptacle sites in the bus bars are accessible from the major surface 26 through openings 164, 166, 168 which extend to the slots 74, 76, 78 that receive the bus conductors. The slots are slightly enlarged in the vicinity of the receptacle sites as shown at 170, 172 (FIG. 2) in order to permit the side walls of the bus bars to move apart when the male terminals are inserted. Otherwise, the bus bars are closely confined in their respective slots in order that they will be precisely positioned with respect to their associated cable wires.

Cavities of substantial width are provided in the lower surface of the housing body 60 as shown at 174, 176 for the portions of the connecting devices 98, 144 which are mated with the bus bars.

The connecting devices extend from the bus bars to the cable wires and must therefore extend through the clamping section 42 and the retaining plate 62. Suitable openings are therefore provided in the plate as shown at 178, 180, and 182. The upper section 42 of the cable clamping subassembly 36 is also provided with openings 190, 192, 194 at locations where the connecting devices must extend to the individual cable wires. The openings in the plate member 42 and the aligned openings in the cover member 62 thus define internal passageways which extend from the individual contacting sites on the ends of the bus bars to the cable locating means in the cable locating subassembly 36. As shown in FIG. 2, it is necessary to provide recesses 196, 198, and 200 for the end portions of the connecting devices since these end portions extend past the plane occupied by the cable wires.

It is desirable to provide openings as shown at 187, 186, and 188 in the cover plate 62 in order that there will be clearance for the end portions of the male tab terminals if the dimensions of the parts are such that these tab terminals extend past the ends of the side walls of the bus bars. In FIG. 31, the end portion of the tab terminal 12 does in fact extend beyond the ends 96 of the side walls 86 so that an opening in the cover plate would be required.

The cable tap connector 2 is assembled and installed on the cable 10 in the following manner. The cable 10 is first positioned as shown in FIG. 4 between the two sections 40, 42 of the cable clamping subassembly and the two sections are assembled to each other by means of the latch arms 52 so that the cable will be firmly clamped in the subassembly. The individual bus bars 80, 82 and their connecting devices 98, 144 are assembled to the main housing body 60. The cover 62 is then assembled to the housing body 60 and secured in place by fasteners as described above. The two subassemblies 36, 38 are then pressed together so that the connecting devices move through the passageways and penetrate the insulation of the cable 10. The individual cable wires 4, 6, 8 are received in the wire-receiving slots of the connecting devices thereby establishing conducting paths extending from the cable wires to the bus bars as required. Finally, the snap fasteners 72 are assembled to two subassemblies to secure the parts in their assembled relationship. The individual connectors 14–18 can then be mated with the cable connector in the zones on the major surface described above thereby to connect the male tabs extending from the connectors to the cable wires.

FIG. 34 shows in schematic form an alternative embodiment in the form of a cable splice assembly, cable tap and splice or junction box 200 which is capable of forming splice connections between the ends of cables 202, 204 in addition to connections between male tab members and the wires in the cables. In this embodiment, each bus bar has two connecting devices or cable contact terminals 210, 212, 214 located adjacent to the center of the bus bar so that one of the connecting devices will engage a conductor in the end 206 of the cable 202 and the other connecting device will engage the corresponding conductor in the end 208 of the cable 204 so that the aligned corresponding conductors in the cables will be connected to each other. This feature of splicing the ends of cables can be used independently of the cable tapping capabilities of the system. It should be added, also, that under some circumstances, it may be desirable to provide two connecting devices on each bus bar for making two connections to the cable wires purely for purposes of redundancy.

The cable tap and splice assembly 200 of FIGS. 34–37 provides the means to interconnect cable wires 216 and 218 in flat. cables 202, 204, both to other cables in the form of a splice configuration and to provide a tap so that components may be interconnected to the flat cable forming the electrical distribution system. In the cable tap and splice assembly, cable wires of different sizes can be spliced or tapped. As with the cable tap embodiment depicted in FIGS. 1–33, one cable wire 216 can be a wire suitable for 15 to 20 amp current distribution. For example, these conductors can be 12 to 14 gauge conductors. Smaller signal cable wires 218 can be 24 gauge conductors.

In the embodiment of FIGS. 34–37 the same main housing, or cable tap housing or junction box housing 220 is used as for the embodiment of FIGS. 1-33. The bus conductors 222 located in the main housing are the same as the bus conductors used in the embodiment of FIGS. 1-33. As in the standard bus conductors, bus conductors 222 have cable tap locations or receptacles 224 located on one edge of the bus conductor 222 so that the receptacles 224 are accessible from the front of the main housing or junction box 220.

The cable contact terminals 210, 212 and 214 are also identical to the cable connecting devices in the embodiment of FIGS. 1-33. These cable contact terminals 210, 212 and 214 are for connecting a cable wire 216, 218 to a corresponding bus conductor 222 and for establishing electrical contact with the cable wires in each flat cable so that corresponding cable wires in two flat cables are interconnected through the bus conductors 222 in the housing 220. As in the embodiment of FIGS. 1-33, the cable contact terminals 210, 212 and 214 are separate from the bus conductors 222 but are attachable to the bus conductors. Each of the cable contact terminals also includes a cable contact section 226 which extends from the cable tap housing 220.

The cable clamp 228 used in the cable tap and splice assembly is similar to the cable clamp used in the embodiments of FIGS. 1-33 in that cable clamp 228 is separate from and is attachable to the main housing 220 and comprises two parts which are secured together. Clamp 228, however, differs in that the cable clamp 228 includes a partition 236 positioned within a slot 238 so that the partition 236 is retained between two plate like parts 228*a* and 228*b* when the two plate like parts are attached to each other.

Cable clamp 228 has grooves 230, 232 extending inwardly from opposite ends of both of the two parts of the cable clamp. These grooves 230, 232 comprise first and second means for receiving a flat cable with corresponding cable wires in each cable being aligned end to end. Since the flat cable employed in this invention has a rounded contour on the exterior, corresponding to the location of each cable wire, the rounded contours of the cable fit within the grooves 230 and 232 to properly position the cable within the cable clamp.

Cable clamp 228 also has apertures 234 in the cable clamp intersecting the grooves 230, 232. One aperture 234 is positioned in alignment with each cable wire positioned within the grooves 230, 232. These apertures 234 extend inwardly from one face of the cable clamp 228 on opposite sides of the partition 236. These apertures 234 are configured for receipt of one of the cable contact terminals 210, 212, 214 so that separate cables can be spliced through the bus conductors 222 having cable tap locations or receptacles to 224 located on the front of the bus. These apertures 234 are configured to receive the cable contact section of each cable contact terminal 210, 212, 214 when the cable tap housing 220 is attached to the clamp 228.

The partition 236 comprises an elongate insulative member which can be positioned within slot 238 so that the partition interrupts the grooves 230, 232 and separates the grooves into first and second means for receiving cables positioned within the cable clamp. The partition 236 is removably positioned within two clamp parts 228*a*, 228*b* so that the partition 236 is separable from the cable clamp 228 and so that the partition 236 is retained between the two cable clamp parts. Partition 236 is thus removable from the cable clamp so that a single cable can extend through the cable clamp, as with the embodiment of FIGS. 1-33. When the partition 236 is positioned within slot 238, interrupting groove 230, 232, two separate flat cables 202, 204 can be inserted into the grooves 230, 232 on opposite sides of the cable clamp 228 with the ends of each of the flat cables 202, 204 abutting the partition 236.

The embodiment of FIGS. 33-37 thus provides a cable splice assembly, cable tap and splice assembly or junction box 200 used for interconnecting a plurality of cable wires in two flat cables 202, 204 for use in an electrical distribution system. As shown in FIGS. 33-37, this embodiment comprises a junction box 200 for use in connecting components to an electrical system in which the cables are accessable at the junction box. Since the cables are accessable at the junction box, the tap to the flat cables can only be supplied at the junction box, but the cables themselves can be easily spliced together at the location of the junction box. This splicing does not require additional conductive elements since the splice is established through the bus conductors having a receptacle on the bus. Thus, the present invention is especially suitable for use in an electrical distribution system in a structure, such as a house, where the multiconductor cables in the electrical distribution assembly are inaccessible except at certain spaced apart locations.

FIGS. 38 and 39 show still another embodiment of the invention in which the cable tap and splice assembly 200 is intended for use with cables having a fewer number of conductors. In the embodiment of FIGS. 38 and 39, three large cable wires 216 are combined with six signal wires 218. Otherwise, the configuration of the cable clamp used in FIG. 38 and 39 is substantially the same as the embodiment of FIGS. 33-37. The perspective view of FIG. 38 shows partition 236 which is essentially the same as the partition used in the embodiment of FIGS. 33-37.

Elements of each of the assemblies previously described can be varied. For example, the bus bars can be of a single thickness of sheet metal rather than being folded as described above. As an alternative, the bus bars can be in the form of a rod or heavy gauge wire. If the rod is a wire, the receptacle sites can be receptacle connecting devices and crimped onto the bus conductors. The connecting devices can similarly be crimped onto a wire-type bus.

The bus bars can, if desired, extend normally of the cable wires rather than parallel to the wires, if desired. The parallel arrangement shown is preferable for the reason, among others, that connections between the individual bus conductors and the wires can be placed at any location along the length of the bus conductor.

The invention can be used under a wide variety of circumstances in which several different types of circuits are required and particularly where different wire gauges are required. For example, in the wiring of a building, the power can be supplied by the coarse gauge wires, communications and control circuits can be connected to the fine gauge wires, and the intermediate gauge wires can be used for emergency circuits (e.g., emergency lighting) which are required in the event of a power failure.

It will be seen from the foregoing description that the invention provides a relatively simple, and therefore reliable, system for making multiple tap connections to single wires in a flat conductor cable. Furthermore, the system is extremely versatile in that the connector receiving zones 28-34 on the major surface 26 can extend across any or all of the bus bars so that the terminal tabs in a single connector can be selectively connected to any of the cable wires. FIGS. 1 and 3 show only one possible arrangement for the connectors and it should be pointed out that any number of individual zones can be provided on the major surface for any number of connectors desired.

We claim:

1. A cable splice assembly for interconnecting a plurality of cable wires in two flat cables, the cable splice assembly comprising:

a first housing;

a plurality of bus conductors located in the first housing;

a plurality of cable contact terminals, each for connecting a cable wire to a corresponding bus conductor;

a cable clamp separate from and attachable to the first housing, the cable clamp having first and second means for receiving a flat cable on opposite ends of the cable clamp, with corresponding cable wires in each cable being aligned end to end, the cable clamp also having apertures intersecting each means for receiving a flat cable, one aperture being positioned in alignment with each cable wire when positioned in the means for receiving a flat cable; and a partition located in the cable clamp between the first and second means for receiving a flat cable, so that each flat cable can be positioned within the corresponding receiving means with ends of each flat cable abutting the partition, whereby the cable contact terminals establish electrical contact with corresponding cable wires in each flat cable and corresponding cable wires in each flat cable are interconnected through the bus conductors in the first housing.

2. The cable splice assembly of claim 1 wherein the cable clamp comprises two plate like members, with the partition being retained between the two plate like members.

3. The cable splice assembly of claim 1 wherein the partition is separable from the cable clamp.

4. The cable splice assembly of claim 3 wherein the cable clamp includes a slot in which the partition can be positioned.

5. The cable splice assembly of claim 4 wherein the cable clamp comprises two parts, the slot being located in one of the two parts.

6. The cable splice assembly of claim 5 wherein the means for receiving a flat cable comprises grooves in at least one of the two part members in the cable clamp.

7. The cable splice assembly of claim 6 wherein the slot intersects the grooves to define the first and second means for receiving a flat cable.

8. The cable splice assembly of claim 1 wherein the cable contact terminals are attached to the bus conductors.

9. The cable splice assembly of claim 8 wherein the cable contact terminals engage the corresponding cable wires when the cable clamp is attached to the first housing.

10. The cable splice assembly of claim 9 wherein the cable contact terminals are separate from the bus conductors.

11. A cable tap and splice assembly for use in an electrical distribution system in a structure in which multiconductor cables in the electrical distribution system are inaccessible except at spaced apart locations, individual cables being spliced together to form the electrical distribution system, the cable tap and splice assembly comprising:

a cable tap housing;

a plurality of bus conductors located in the cable tap housing, each bus conductor including at least one cable tap location;

a plurality of cable contact terminals, each for connecting a cable wire to a corresponding bus conductor;

a cable clamp separate from and attachable to the cable tap housing;

a partition in the cable clamp; and a plurality of apertures extending inwardly from one face on the cable clamp on opposite sides of the partition, each aperture being configured for receipt of one of the cable contact terminals so that separate cables can be spliced through bus conductors having cable tap locations on the bus.

12. The cable tap and splice assembly of claim 11 wherein the partition is removable from the cable clamp so that a single cable can extend through the cable clamp.

13. The cable tap and splice assembly of claim 11 wherein the cable clamp comprises two parts secured together with the partition between the two parts.

14. The cable tap and splice assembly of claim 11 wherein the cable contact terminals are positioned in the cable tap housing, each contact terminal including a cable contact section extending from the cable tap housing, the apertures being configured to receive the cable contact section when the cable clamp is attached to the cable tap housing.

15. The cable tap and splice assembly of claim 11 wherein the cable clamp has a plurality of grooves, the partition interrupting the grooves.

16. The cable tap and splice assembly of claim 15 wherein the cable calmp includes a slot extending transversely to the grooves, the partition being removably positioned within the slot.

17. A junction box for use in connecting components to an electrical distribution system formed by multiconductor cables accessible at the junction box, a plurality of multiconductor cables being spliced to form the electrical distribution system, the junction box comprising:

a junction box housing;

a plurality of bus conductors located in the junction box housing, each bus conductor including at least one receptacle accessible on the front of the junction box housing;

a plurality of cable contact terminals, each for connecting a cable wire to a corresponding bus conductor;

a cable clamp separate from and attachable to the rear of the junction box housing;

a partition in the cable clamp; and a plurality of apertures extending inwardly from one face on the cable clamp on opposite sides on the partition, each aperture being configured for receipt of one of the cable contact terminals so that two cables can be positioned in a cable clamp and can be spliced, at a location of a junction box, through bus conductors having receptacles on the bus conductors.

* * * * *

UNITED STATES PATENT OFFICE

CERTIFICATE OF CORRECTION

Patent No. 5,064,380 Dated November 12, 1991

Inventor(s) James L. Dale, Vernon R. Miller, Lincoln E. Roberts

It is certified that error appears in the above-identified patent and that said Letters Patent is hereby corrected as shown below:

In claim 17, column 12, line 60, the word "on" second occurrence should be --of--.

In the Abstract, line 7, change "connector" to --conductor--.

Signed and Sealed this

Twenty-second Day of June, 1993

*Attest:*

Michael K. Kirk

MICHAEL K. KIRK

*Attesting Officer*

*Acting Commissioner of Patents and Trademarks*